United States Patent [19]

Kubota et al.

[11] 4,064,616

[45] Dec. 27, 1977

[54] METHOD FOR CONSTRUCTING A BLAST FURNACE

[75] Inventors: Katsuyuki Kubota, Tokyo; Noboru Fujii; Kouichi Yamada, both of Fukuoka; Kimikazu Nakamura, Tokyo; Norihito Yuuki, Chiba, all of Japan

[73] Assignee: Sankyu Inc., Fukuoka, Japan

[21] Appl. No.: 728,373

[22] Filed: Sept. 30, 1976

[30] Foreign Application Priority Data

Oct. 2, 1975 Japan ..... 50-119613

[51] Int. Cl.[2] ..... E04G 21/00

[52] U.S. Cl. ..... 29/429; 52/747

[58] Field of Search ..... 29/429, 469; 52/745, 52/747, 741

[56] References Cited

U.S. PATENT DOCUMENTS

| | | | |
|---|---|---|---|
| 2,862,252 | 12/1958 | Beach, Jr. | 29/429 |
| 3,431,691 | 3/1969 | Greaves et al. | 52/741 |
| 3,492,767 | 2/1970 | Pincus | 52/745 |
| 3,673,754 | 7/1972 | Murashige et al. | 52/747 |
| 3,751,783 | 8/1973 | Roberts, Jr. et al. | 29/469 |
| 3,895,473 | 7/1975 | Fraser | 29/429 |
| 3,956,816 | 5/1976 | Short | 29/429 |

*Primary Examiner*—C.W. Lanham
*Assistant Examiner*—Daniel C. Crane
*Attorney, Agent, or Firm*—Pollock, Vande Sande & Priddy

[57] ABSTRACT

A method for constructing a blast furnace, in which the blast furnace is designed to be divided into a plurality of blocks with a deck frame and other parts, and these blocks are individually assembled on the ground in a sequential order from the furnace top to the furnace bottom. The individual blocks are conveyed one after another onto a foundation, and the furnace top block is initially lifted up. In this manner, the successive blocks are lifted up in the described order and joined together at their ends to complete the blast furnace.

2 Claims, 33 Drawing Figures

METHOD FOR CONSTRUCTING A BLAST FURNACE

BACKGROUND OF THE INVENTION

This invention relates to a method for constructing a blast furnace.

Prior art methods for constructing a blast furnace have been defective in that they comprise extremely troublesome construction steps and require an extended period of time for construction. Further, the prior art methods have been defective in that they require very dangerous work to be carried out at an elevated level, such as ninety meters above the ground.

SUMMARY OF THE INVENTION

With a view to obviate the defects of the known construction processes, it is a primary object of the present invention to provide a novel method for constructing a blast furnace within a greatly shortened period of time and eliminating dangerous work at an elevated level, thereby ensuring the safety of workers participating in the blast furnace construction.

In accordance with the present invention, there is provided a method for constructing a blast furnace comprising the steps of:

a. erecting an additional tower for blast furnace erecting and dismantling purposes on a support column assembly supporting the body of the blast furnace on a foundation, and mounting a multiplicity of detachable hydraulic lifting means on said additional tower;

b. assembling, in an assembling shop located on the ground in an area spaced apart from the blast furnace foundation, the blast furnace including charging appliances, a deck frame tower, a gas up-take and part of a downcomer divided into a plurality of blocks including a furnace top block, intermediate blocks and a furnace bottom block, and applying brick lining, painting, electrical instrumentation, wiring, piping and any other necessary fittings to said blocks in said shop;

c. conveying said blocks in a sequential order from said furnace top block to said furnace bottom block from said assembling shop onto said foundation by a carriage having a frame structure serving itself as part of the furnace bottom structure, and lifting up the first one of said blocks conveyed onto said foundation by suitable ones of said hydraulic lifting means;

d. joining the second one of said blocks to said first block lifted up already in said step (c) while maintaining said second block placed on the frame structure of said carriage; and e. repeating said steps (c) and (d) over a required number of times to lift up all the furnace sections except the furnace bottom section by said hydraulic lifting means, and then fixing said frame structure of said carriage on said foundation while maintaining said furnace bottom block placed on said frame structure of said carriage thereby completing the furnace bottom structure.

The method according to the present invention, having the aforementioned features, provides the following advantages:

i. The possibility of an accident resulting in injury or death of workers can be minimized due to the fact that the furnace sections and deck frame tower portions are assembled on ground. Further, the time-consuming work such as electrical instrumentation, painting and piping work can be quickly carried out to shorten the period of time required for the construction, due to the fact that all these operations are also carried out on ground.

ii. The furnace body support column assembly having a high mechanical strength is utilized for the successive lift-up operation of the divided blocks of the blast furnace. Therefore, the load of very great weight can be easily lifted up thereby minimizing dangerous work at an elevated level and shortening the period of time required for the construction.

iii. The additional tower erected on the support column assembly for lifting up the individual blocks of the blast furnace is left in position to be utilized for later dismantling of the blast furnace. Therefore, the blast furnace can be dismantled within a short period of time.

iv. Substantial sections of the blast furnace and deck frame tower can be assembled on the ground. Therefore, the welding and painting work can be automated as required, and the precision of such work can be improved.

v. According to the method of the present invention, the period of time required for the construction can be shortened, and the joining and other operations to be carried out at an elevated level can be reduced. Therefore, a great deal of reduction in the construction costs can be achieved in the construction of a blast furnace particularly in those regions, for example, in which the weather is generally unsettled, or in which there are extremely severe environmental conditions, or a region where skilled workers are not available.

BRIEF DESCRIPTION OF THE DRAWINGS

FIGS. 4 and 5 show the structure of a carriage preferably employed in the method of the present invention, wherein FIG. 4 is a plan view of the carriage, and FIG. 5 is a partly sectional side elevational view of the carriage.

FIGS. 7 to 11 show the structure of a hydraulic lifting unit preferably employed in the method of the present invention, wherein FIG. 7 is a front elevational view of the hydraulic lifting unit, FIG. 8 is an enlarged front elevational view of part of the hydraulic lifting unit, FIG. 9 is a longitudinal sectional view of a hydraulic cylinder and a plunger, FIG. 10 is a sectional view of a half nut having a ring fitted thereon, and FIG. 11 is a perspective view of the half nut and ring.

DETAILED DESCRIPTION OF THE INVENTION

Figures 1, 2, 3:
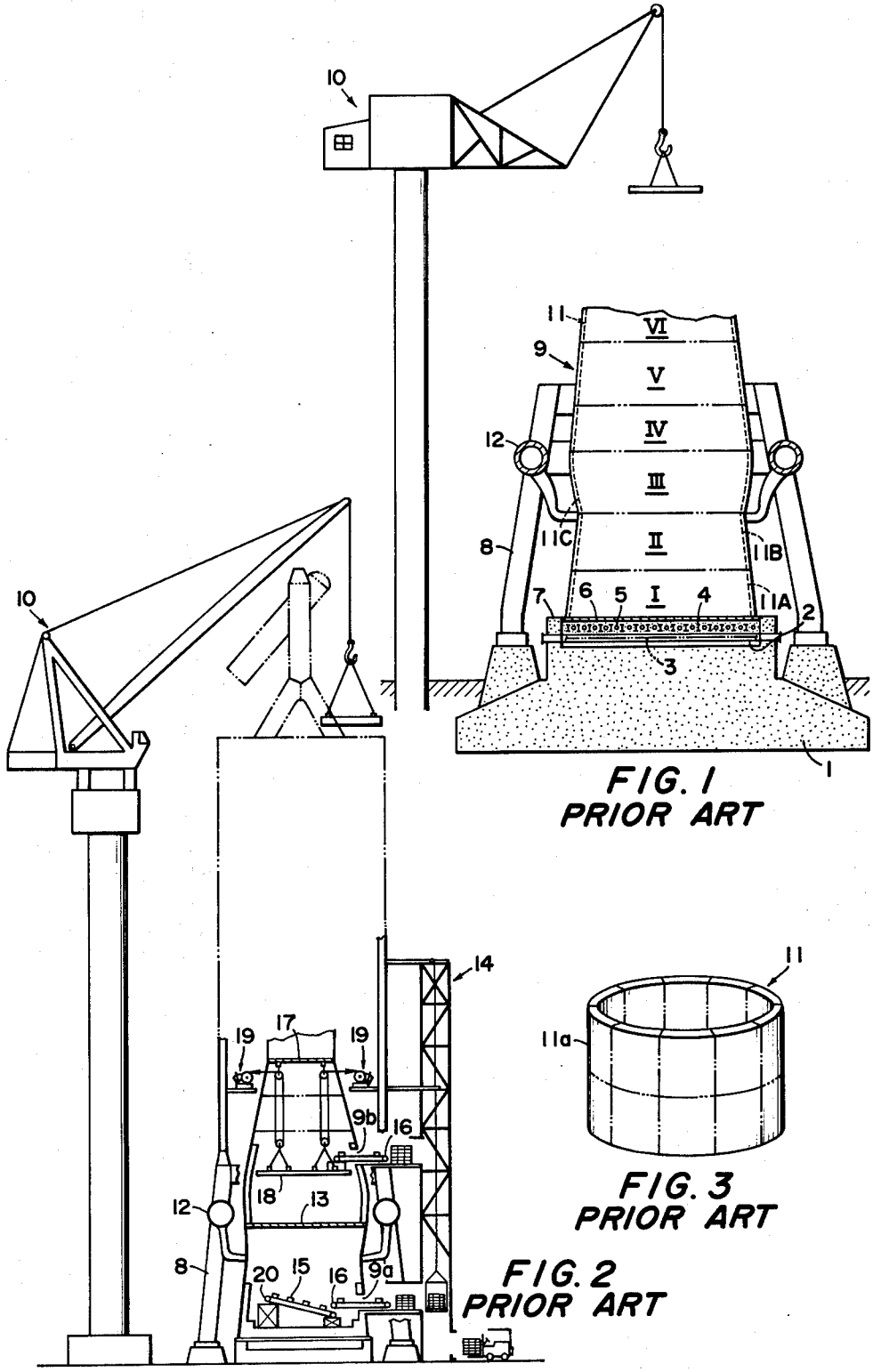
FIG. 1 PRIOR ART
FIG. 3 PRIOR ART
FIG. 2 PRIOR ART
FIGS. 1 to 3 illustrate a prior art method for constructing a blast furnace.

For a clear understanding of the construction method according to the present invention, a prior art construction method will be briefly described with reference to FIGS. 1 to 3 prior to describing a preferred embodiment of the present invention in detail.

According to the prior art method, a blast furnace is constructed in a manner as described below. Referring first to FIG. 1, a multiplicity of I-beams 2 are arranged in parallel on a pre-formed foundation 1, and cooling air conduits 3 are disposed between these I-beams 2. A multiplicity of similar I-beams 4 are then arranged on the I-beams 2 in perpendicular relation with the latter. After disposing cooling water conduits 5 between these I-beams 4, a refractory material such as graphite is filled into the spaces between the individual I-beams 2 and 4 and the spaces between the individual conduits 3 and 5, and then, a thick steel plate 6 is placed on the stack to complete a flat bottom base 7 including the bottom staves.

The flat bottom base 7 is completed in the manner above described. In the meantime, a tower crane 10 is erected in the neighborhood of the foundation 1 to erect a furnace-body support column assembly 8 and to construct a furnace body 9. This tower crane 10 is used to lift up the elements constituting the support column assembly 8 and furnace body 9.

After the erection of the tower crane 10, this tower crane 10 is operated to convey the constituents of the support column assembly 8 onto the foundation 1 for assembling or connecting these constituents with one another successively so as to complete the furnace-body support column assembly 8 from the lower end thereof.

The construction of the furnace body 9 is started after the erection of the support column assembly 8 or after the completion of the flat bottom base 7. The furnace body 9 is previously designed to be composed of a plurality of sections as, for example, shown by I, II, III, IV, . . . in FIG. 1, and the construction of the furnace body 9 is started from the bottom section I. At first, the shell portion of the bottom section I is assembled on the foundation 1, and then, the shell portion of the next upper furnace body section II is joined to the upper end of the shell portion of the bottom section I. In this manner, portions of the shell 11 of the furnace body 9 are successively stacked up and joined together starting from that of the bottom section I until these portions of the shell 11 of the furnace body 9 are assembled up to a predetermined height. For example, the shell portions including the shell portion of the furnace body section III are assembled in FIG. 1. Subsequently, an intermediate safety deck 13 is mounted on the upper end of the shell portion of the furnace body portion III as shown in FIG. 2 to cover the furnace body sections I to III. This intermediate safety deck 13 is provided for preventing rainwater or dangerous matter from intruding or falling into the internal space of the already assembled shell portions of the furnace body sections.

After the intermediate safety deck 13 has been mounted on the upper end of the shell portion of the furnace body section III assembled with the furnace body sections II and I in the manner above described, the work for lining the in-wall of the shell portions of the furnace body sections I to III with bricks is started, and at the same time, a bustle pipe 12 is lifted up to be suspended from and supported by the upper end beams of the furnace-body support column assembly 8. Subsequently, the shell portions of the furnace body sections disposed above the intermediate safety deck 13 are assembled in a manner similar to that above described.

A brick conveying elevator tower 14 is erected previously adjacent to the furnace-body support column assembly 8 as shown in FIG. 2 for conveying furnace lining bricks 15 into the furnace body 9, and this elevator tower 14 is used to lift the bricks 15 up to a predetermined level together with a pallet.

Openings 9*a* and 9*b* such as a tapping hole and a tuyere or an armor have already been provided in the assembled shell portions of the furnace body 9. Belt conveyors 16 of small size are disposed between the elevator tower 14 and these openings 9*a* and 9*b* to convey the bricks 15 into the shell 11 from the elevator tower 14.

A vertically movable scaffolding 18 is suspended from another intermediate safety deck 17 disposed above the intermediate safety deck 13 as shown in FIG. 2, and workers on this scaffolding 18 carry out the lining of the in-wall of the shell 11 with the bricks 15. This scaffolding 18 is gradually raised by winches 19 driving upper pulleys.

Another conveyor 20 is used to convey the bricks 15 into the internal space of the shell 11 since the inner diameter of the shell 11 is very large.

In the shell portions in which the furnace lining work has been completed, the intermediate safety decks 13 and 17 are cut into suitable lengths or disassembled to be conveyed to the exterior through the openings 9*a* and 9*b* as waste.

In such a known process for constructing a blast furnace, a tower crane is generally used as means for conveying the materials constituting the shell of the furnace body. Therefore, the period of time required for the construction of the blast furnace at the construction site will be shortened when the tower crane has an extremely great allowable lifting capacity. However, 60 tons is the allowable liftable limit of tower cranes of largest size presently used with a maximum working radius of 40 meters, and this allowable liftable limit is very small compared with the total weight of the shell of the blast furnace to be constructed. Thus, a great deal of man-hours and a very long period of time have been required for the blast furnace to be constructed according to the prior art method. For example, according to the prior art method for constructing the blast furnace, the shell portion 11 of each furnace body section is designed to be composed of a plurality of steel plates 11*a* as shown in FIG. 3, and each of these steel plates 11*a* has a predetermined weight which does not exceed the allowable lifting capacity (for example, 60 tons) of the tower crane. Thus, many steps are required for welding the steel plates to each other on the foundation 1 when the shell portion is designed to be composed of many steel plates in a manner as above described. Further, such shell making work must be carried out at a level of increased height with the progress of construction of the furnace body, tending to be attended with the possibility of an accident resulting in injury or death of workers and giving rise to the possibility of degradation of the precision of work. Further, when a large-sized tower crane is used in an area in which radio waves have a high intensity, the crane may act as an antenna resulting frequently in objectionable resonance of the crane with the wire connected to the hanging hook, thereby charging the crane with a high electrical potential. Discharge of this high electrical potential from the hanging hook or other parts of the crane may impart an electrical shock to the body of workers. It is thus acknowledged that the use of a tower crane of excessively large size is extremely dangerous.

As will be apparent from the above description, the prior art method for constructing a blast furnace has included various problems to be solved, and there has been a need to solve these problems.

The inventors have conducted research and studies in an effort to solve the problems involved in the known method for blast furnace construction and have invented a novel method which makes it possible to construct a blast furnace with a shorter period of time and which eliminates substantially the possibility of an accident fatal to workers working at an elevated level. The method according to the present invention is, in brief, based on the so-called lift-up method, but it takes into account the peculiarity of blast furnace construction so as to provide many features distinctly different from those of the known lift-up method.

Briefly, the method according to the present invention is featured by various steps comprising assembling a plurality of furnace body blocks including a furnace top block, intermediate blocks and a furnace bottom block fitted completely with brick lining, painting, electrical instrumentation, wiring, piping and other necessary elements in an assembling shop erected in an area remote from the foundation of the blast furnace, conveying successively these blocks from the assembling shop onto the foundation by a carriage having a frame structure which serves itself as a flat bottom base in the bottom structure of the blast furnace, lifting up successively these blocks on the foundation in the sequential order of from the furnace top block to the furnace bottom block, and finally securing the furnace bottom block and the frame structure of the carriage together on the foundation to complete the furnace bottom structure of the blast furnace. According to the important features of the method of the present invention, the frame structure of the carriage used for conveying the individual blocks constituting the furnace body provides the flat bottom base in the bottom structure of the blast furnace, and the individual blocks constituting the furnace body are lifted up by hydraulic jacks mounted on the frame structure of the carriage. Therefore, the individual blocks of heavy weight can be lifted up without deforming the shell of the blocks, and the upper and lower blocks can be joined together precisely. Further, excessive loads are not imparted to the lifting means.

The method according to the present invention is thus advantageous over the prior art method in that the period of time required for the construction of a blast furnace can be remarkably shortened compared with heretofore. Further, the possibility of an accident resulting in injury or death of workers owing to the construction work at an elevated level can be minimized due to the fact that most of the steps for the construction of the furnace body are carried out in the assembly shop erected on ground. Furthermore, the method according to the present invention can reduce the possibility of deformation of the furnace body blocks during erection of the blast furnace. Moreover, the present invention is advantageous in that the precision of assembling of the furnace body blocks can be improved since jigs and automatic welding apparatus can be used in many of the assembling steps. Another advantage of the present invention is that troublesome electrical instrumentation, wiring and piping can be fitted to the blocks on ground.

The general concept of the method of the present invention is apparent from the appended claims. A preferred embodiment of the present invention will now be described with reference to FIGS. 4 to 33 of the accompanying drawings.

In the method according to the present invention, a carriage used for successively conveying a plurality of blocks constituting the body of a blast furnace is made prior to the construction of the blast furnace. In the meantime, a furnace-body support column assembly is erected on the foundation, and an additional tower used for erecting and dismantling purposes is then erected on the support column assembly.

Figure 4:
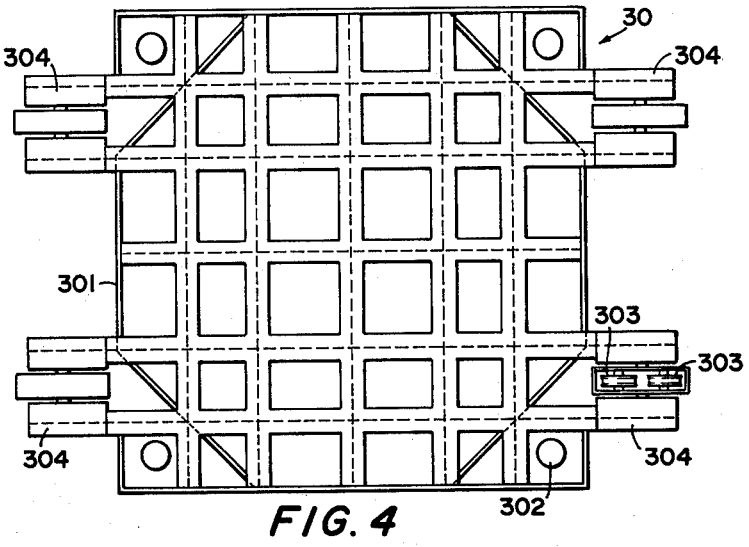
Figure 5:
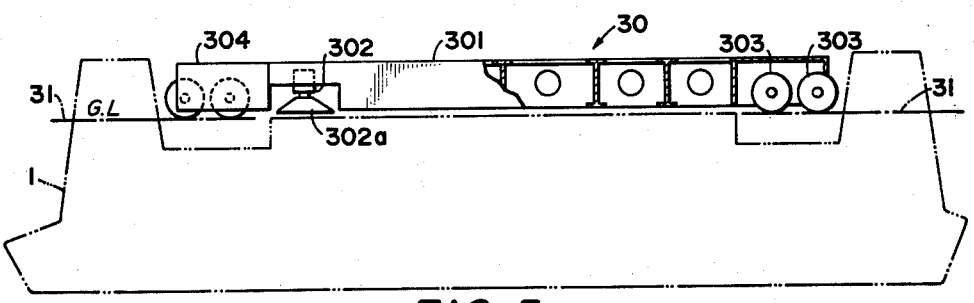

Referring to FIG. 4, the carriage used in the method according to the present invention is generally designated by the reference numeral 30 and comprises a frame structure 301 which serves itself later as a flat bottom base in the bottom structure of the blast furnace. This frame structure 301 is made by combining H-beams of high mechanical strength in a grid-like pattern, and hydraulic jacks 302 of large capacity are detachably disposed at the four corners of the frame structure 301 as shown in FIGS. 4 and 5. Two pairs of trucks 304 each supporting a pair of wheels 303 are respectively connected to the opposite ends of the frame structure 301 so that the frame structure 301 can be supported on the wheels 303 through the trucks 304. When the carriage 30 travels, the hydraulic jacks 302 have their legs **302*a* retracted relative to the frame structure 301 to move with the carriage 30, while when a load of heavy weight carried by the carriage 30 is lifted up, the legs 302*a* of the hydraulic jacks 302 are extended to press against the bed for the track or ground to lift up the load on the frame structure 301 together with the frame structure 301**.

Rails 31 guiding the wheels 303 of the carriage 30 are laid on the ground level GL as shown in FIG. 5 and extend between the foundation 1 supporting the blast furnace and an assembly shop (not shown). The bed of the track for the carriage may be utilized as the bed of rails for ladle cars after the completion of a blast furnace.

Figure 6:
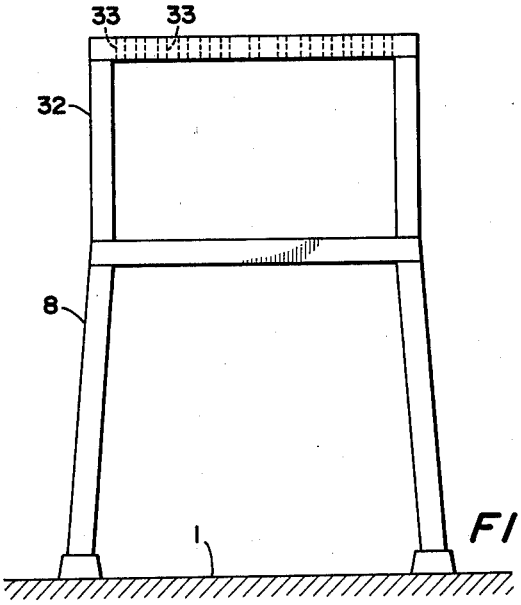
FIG. 6 shows a state in which an additional tower employed in the method of the present invention is erected on a support column assembly erected on the foundation.

The laying of the rails 31 and the construction of the foundation 1 are simultaneously carried out. After the foundation 1 has been constructed, the furnace-body support column assembly 8 is erected by means such as a truck crane. Subsequent to the erection of the furnace-body support column assembly 8, an additional tower generally designated by the reference numeral 32 in FIG. 6 is erected on the support column assembly 8 to serve the construction and later dismantling of the blast furnace. The assembly shop is erected, simultaneously with the construction of the foundation 1, on ground in an area remote from the foundation 1, and the carriage 30 is assembled on the rails 31 extending into this assembly shop.

A multiplicity of lifting units generally designated by the reference numeral 33 in FIG. 6 are detachably mounted on the upper end beams of the additional tower 32.

Figure 7:
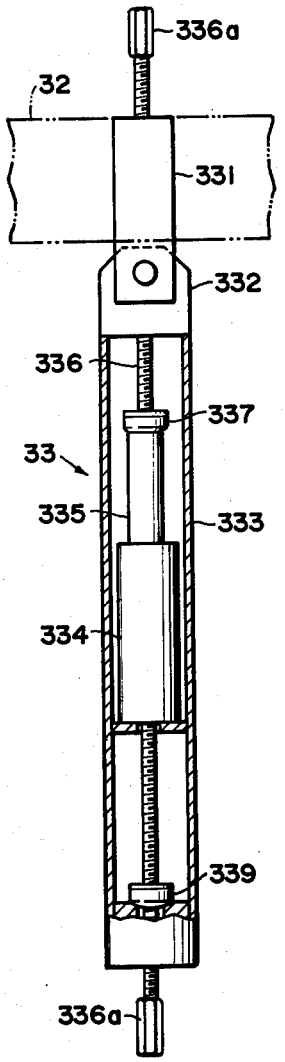
Figure 8:
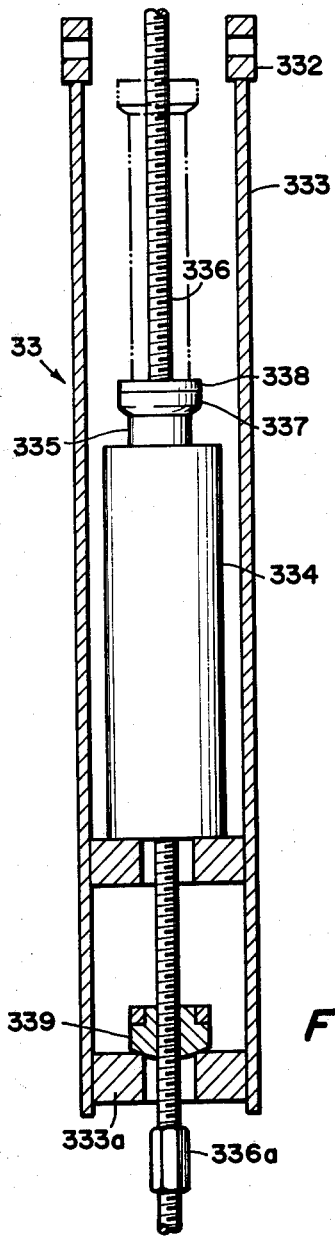
Figure 9:
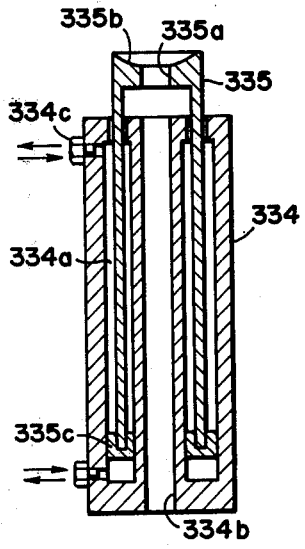

Referring to FIGS. 7 and 8, each of these lifting units 33 comprises a bracket 331 secured to the associated upper end beam of the tower 32, a joint 332 pivoted to this bracket 331, a housing 333, and a hydraulic cylinder 334 housed within this housing 333. The hydraulic cylinder 334 has a double cylindrical structure defining an annular space 334*a* as shown in FIG. 9. This annular space 334*a* has an opening solely at the upper end of the hydraulic cylinder 334, and a cylindrical plunger 335 is inserted into this annular space 334*a* for vertical movement. An annular seal 335*c* is fixed to the lower end of the cylindrical plunger 335, and fluid under pressure is supplied from a lower or upper fluid inlet-outlet port 334*c* into the annular space 334*a* for causing axial vertical movement of the plunger 335 relative to the hydraulic cylinder 334. An axial central bore 334*b* extends through the hydraulic cylinder 334 to register with an opening 335*d* provided in the upper end of the plunger 335, and a threaded rod 336 extends through the axial central bore 334*b* and the opening 335*a*. The outer diameter of this threaded rod 336 is smaller than the inner diameter of the opening 335*a* of the plunger 335 and that of the axial central bore 334*b* of the hydraulic cylinder 334, so that the threaded rod 336 can make free axial vertical movement without any contact with the plunger 335 and the hydraulic cylinder 334.

Figure 10:
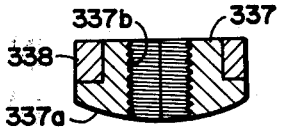
Figure 11:
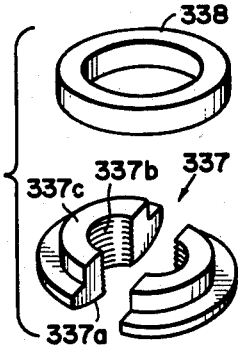

A recess 335*b* having a part-spherical surface is formed in the upper end of the plunger 335 as shown in FIG. 9, and a half nut 337 having a lower surface 337*a* of configuration mating with that of the recess 335*b* as shown in FIG. 10 engages with the recess 335*b*. (This half nut 337 is called a thrust nut.) An axial central bore 337*b* extends through the half nut 337 and is threaded for making threaded engagement with the threaded rod 336. A cylindrical portion 337*c* of small diameter is provided at the upper end of the half nut 337, and a ring 338 having an inner diameter equal to the outer diameter of the cylindrical portion 337*c* is fitted on this cylindrical portion 337*c* as shown in FIGS. 10 and 11. This ring 338 is disengaged from the cylindrical portion 337*c* of the half nut 337 each time the threaded rod 336 is used for lifting a load.

A partition plate 333*a* having an axial central opening is fixed in the housing 333 at a position beneath the hydraulic cylinder 334 and is engaged by another half nut 339 similar to the half nut 337. (This half nut 339 is called a bearing nut.) A coupling 336*a* shown in FIG. 8 is used to couple the threaded rod 336 to another threaded rod, and thus, a very long threaded rod can be provided as required. This coupling 336*a* can also make free axial vertical movement with the threaded rods 336 without any contact with the internal parts of the lifting unit 33.

The lifting unit 33 having such a structure is operated in a manner as described below. In the non-operating state, fluid under pressure is supplied into the hydraulic cylinder 334 from the upper fluid inlet-outlet port 334*c*. Therefore, the plunger 335 is in its lowermost position, and the half nut 337 in threaded engagement with the threaded rod 336 engages with the recess 335*b* formed at the upper end of the plunger 335. The ring 338 is fitted on the cylindrical portion 337*c* of the half nut 337 to tighten the half nut 337. Therefore, the weight of a heavy load carried by the lower end of the threaded rod 336 is imparted to the plunger 335 through the half nut 337.

When now the heavy load is to be lifted up, the ring is disengaged from the cylindrical portion of the lower half nut 339 to release the half nut 339 from threaded engagement with the threaded rod 336. Then, fluid under pressure is supplied into the hydraulic cylinder 334 from the lower fluid inlet-outlet port 334*c* to urge the plunger 335 upward. Then, the threaded rod 336 is urged upward to lift up the heavy load. After the plunger 335 has moved over a predetermined stroke, the lower half nut 339 is brought into threaded engagement with the threaded rod 336 again, and the ring is fitted on the cylindrical portion of this half nut 339 to fix the threaded rod 336 in position by the lower half nut 339. Subsequently, the ring 338 is disengaged from the cylindrical portion 337*c* of the upper half nut 337 to release this half nut 337 from threaded engagement with the threaded rod 336. Thereafter, the plunger 335 is solely urged downward, and then, the plunger 335 is urged upward again to lift up the heavy load in the manner above described.

At the same time the construction of the carriage 30 is started, construction of the blast furnace body and auxiliaries (such as a gas up-take, a downcomer, a deck frame tower, charging appliances and deck frames) is also started at the assembly shop.

According to the present invention, the blast furnace is designed in such a manner that the blast furnace is composed of a plurality of blocks including a furnace top block, intermediate blocks and a furnace bottom block. These blocks are assembled in sequential order to be lifted up. In assembling, therefore, a furnace top block A shown in FIG. 13 is initially assembled at the assembly shop.

Figure 13:
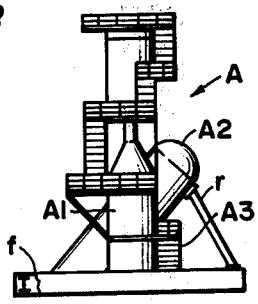
FIG. 13 is a schematic front elevational view of a furnace top block which is initially lifted up.

In assembling the block A, a hanger frame *f* and a temporary support bar *r* used for supporting the upper end of the downcomer A2 are secured to the lower end of the block A so as to facilitate the lift-up operation of the block A because the block A has an asymmetrical shape not suitable for the stable lift-up as seen in FIG. 13.

Figure 14:
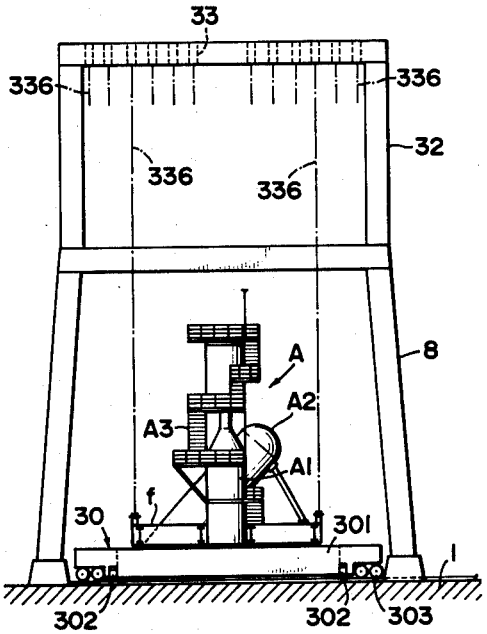
FIGS. 14 to 23 show the steps of lifting up successive blocks until a belly block is lifted up.
Figure 15:
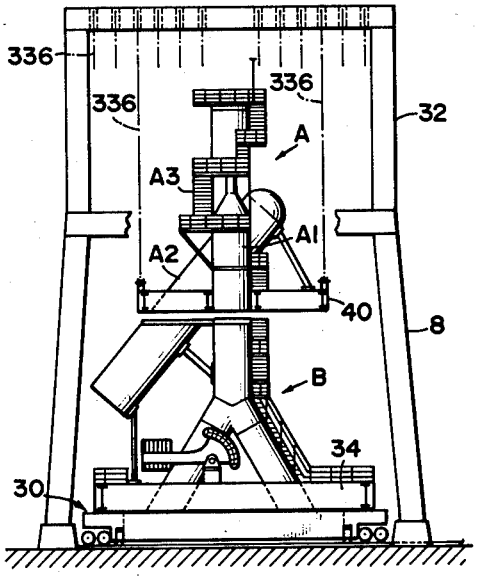

The furnace top block A completed at the assembly shop is put onto the frame structure 301 of the carriage 30 by suitable means and is then conveyed by the carriage 30 onto the foundation 1 as shown in FIG. 14. The furnace top block A conveyed onto the foundation 1 is then lifted up to a predetermined level by some of the many lifting units 33 mounted on the tower 32. This level is selected to be slightly higher than the level to which the next lower block B is to be lifted.

After the furnace top block A has been lifted up, the carriage 30 is immediately returned to the assembly shop and carries the next lower block B (which has already been completed) to convey the same onto the foundation 1.

Intermediate blocks including the block B are provided with the deck frame 34 surrounding their shells 11 or a gas up-take. In lifting up these blocks, it is difficult to lift up the shell 11 or a gas up-take in unison with the deck frame 34 simultaneously because the deck frame 34 is not fixed to the shell 11 or a gas up-take in these blocks.

Figure 12:
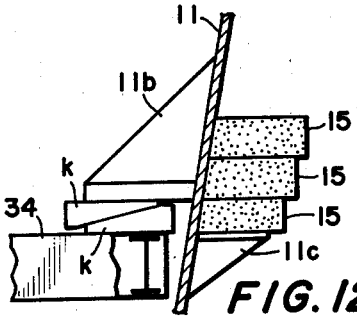
FIG. 12 illustrates the manner of supporting a furnace body section having a deck frame tower portion disposed therearound.

In order to overcome such difficulty, according to the present invention, means for facilitating the lift up operation of these intermediate blocks is used as shown in FIG. 12.

FIG. 12 shows an example of such means. Referring to FIG. 12, a projection 11*b* is fixed to the outer wall surface of the shell portion 11 during the assembling of some of the blocks, and a plurality of wedge-shaped liners *k* are interposed between this projection 11*b* and a deck frame 34 of a deck frame tower portion so as to mechanically connect the furnace body section to the deck frame 34 through the projection 11*b* and the liners *k*. In the lifting up operation, this deck frame 34 is suspended from the threaded rods 336 of the lifting units 33 so that the furnace body section and the deck frame tower portion can be lifted up as an integral unit. In FIG. 12, bricks 15 are shown lining the in-wall of the shell portion 11 and are supported by a support fixture 11*c*.

Figure 16:
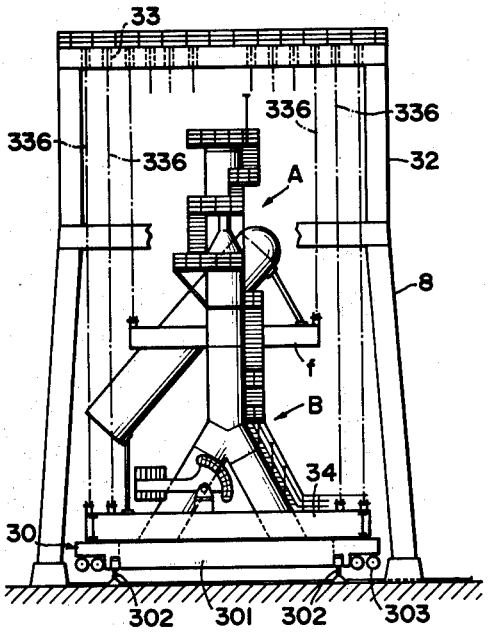
Figure 17:
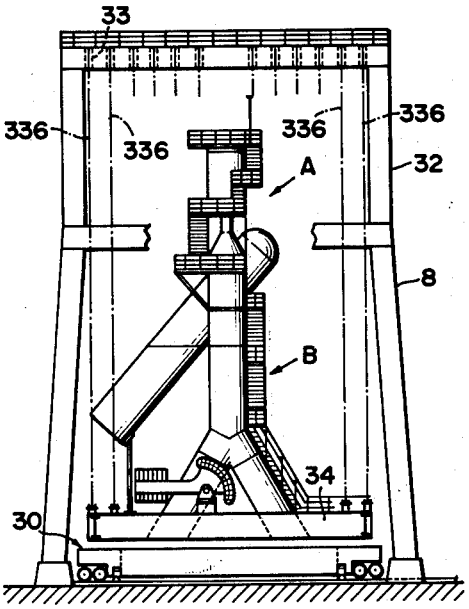

The block B conveyed onto the foundation 1 is then initially lifted up by the hydraulic jacks 302 of the carriage 30 together with the frame structure 301 of the carriage 30 and is pressed against the lower end of the furnace top block A as shown in FIG. 16. The blocks A and B are then joined together in the above state. This joining work is carried out by workers riding on the hanger frame *f* secured to the lower end of the furnace top block A or by workers riding on a working bench (not shown) suspended from the hanger frame *f*. Simultaneously with this joining work, the threaded rods 336 of some of the remaining lifting units 33 are fixed to the deck frame 34 of the block B, and then, the hanger frame *f* secured to the furnace top block A is released from the furnace top block A to be taken out of the position overlying the foundation 1 as shown in FIG. 17.

Figure 18:
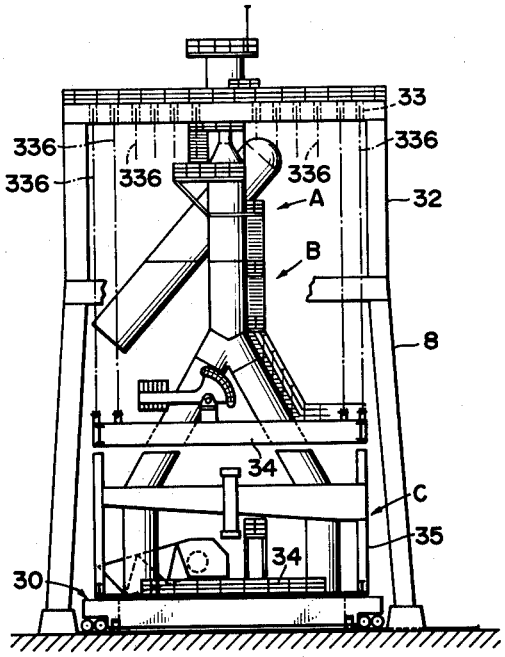

Subsequently, the next lower block C is conveyed onto the foundation 1 from the assembling shop by the carriage 30 in a manner similar to that above described as shown in FIG. 18 and this block C is also lifted up in such a like manner as described above by the hydraulic jacks 302 of the carriage 30 together with the frame structure 301 of the carriage 30. This block C is then similarly joined at the upper end thereof to the lower end of the block B, and at the same time, the threaded rods 336 of some of the remaining lifting units 33 are fixed to a deck frame tower portion 35 surrounding the block C.

Figure 19:
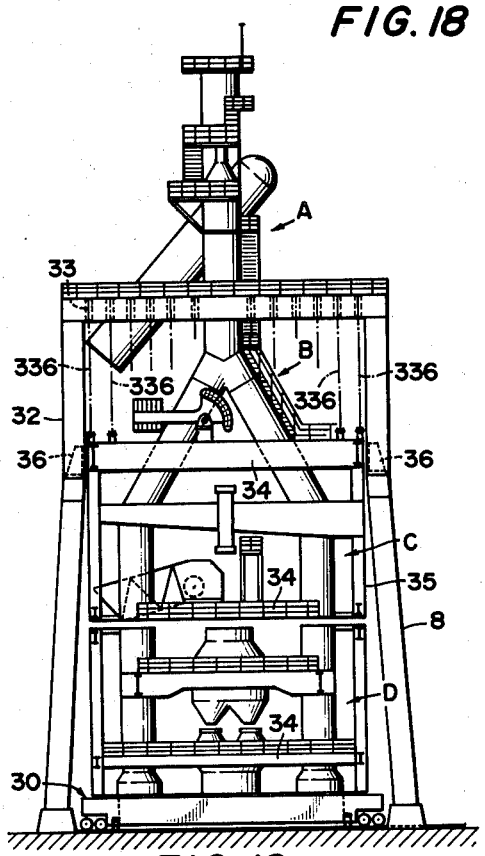

After the blocks including the block C and the upper blocks B and A have been lifted up to the position shown in FIG. 19 by the lifting units 33, support legs 36 as shown in FIG. 19 are fixed to the deck frame tower portion 35.

Figure 20:
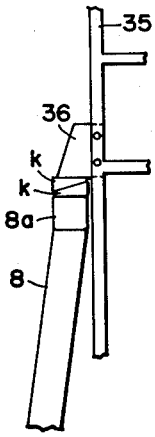
Figure 21:
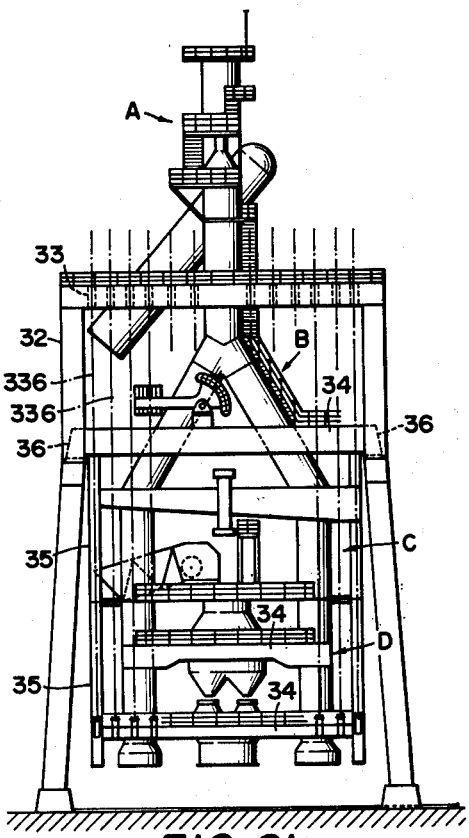

The support legs 36 are fixed to the deck frame tower portion 35 in a manner as best shown in FIG. 20. Subsequently, wedge-shaped liners *k* are interposed between the upper end beams 8*a* of the furnace-body support column assembly 8 and the support legs 36 as shown in FIG. 20 so as to temporarily support the weights of the blocks A to C by the column 8. Then the threaded rods 336 are disengaged from the deck frame 34 of the block C. The block D is then lifted up by the hydraulic jacks 302 of the carriage 30 in a manner similar to that described hereinbefore, and this block D is joined to the lower end of the block C. Subsequently, the threaded rods 336 of some of the remaining lifting devices 33 are anchored to a deck frame 34 of the deck frame tower portion 34 at the lower end of the block D. The blocks A to D are then lifted up by the lifting units 33 as shown in FIG. 21. In this manner, support legs 36 are fixed to the deck frame tower 35 each time two blocks are lifted up, and the total weight of the blocks ranging from the furnace top block A to the lower block is temporarily supported by the furnace-body support column assembly 8.

Figure 22:
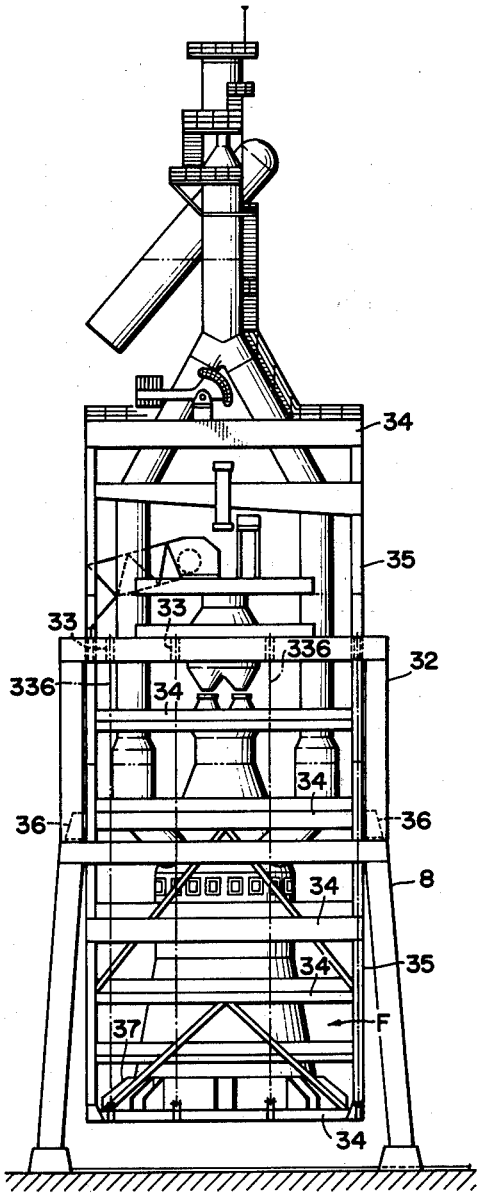
Figure 23:
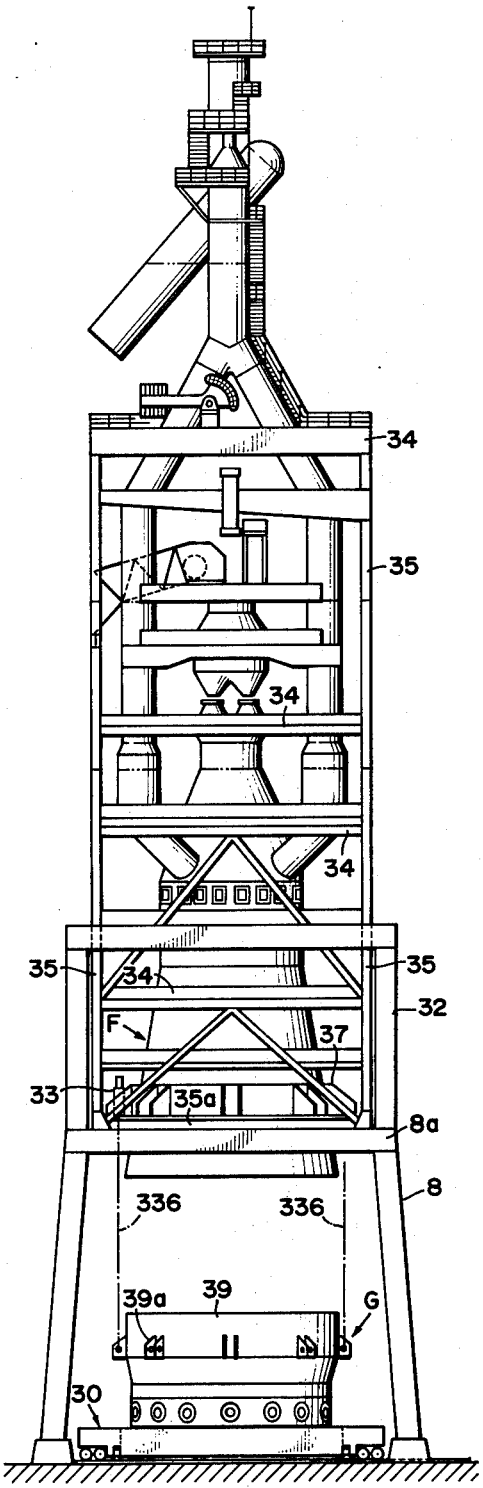

The lifting and joining work proceeds in the manner described above until a belly block F having a ring girder 37 mounted thereon is joined to the upper blocks A to E as shown in FIG. 22. In joining the block F to the upper block E, the block F is similarly lifted up by the hydraulic jacks 302 of the carriage 30 together with the frame structure 301 of the carriage 30. Then the threaded rods 336 of some of the remaining lifting units 33 are anchored to a deck frame 34 of another deck frame tower portion 35 at the lower end of the block F, and the blocks A to F are then lifted up by the lifting units 33 to a position above the upper end beams 8*a* of the furnace-body support column assembly 8 as shown in FIG. 23. Subsequently, as shown in FIG. 24, the ring girder 37 is secured to the upper end beams 8*a* of the furnace-body support column assembly 8 through bottom beams 35*a* and 35*b* of the deck frame tower portion 35 to load the total weight of the blocks A to F on the support column assembly 8.

Another belly block G having a bosh mantle ring 39 fixed thereto is then conveyed onto the foundation 1 as shown in FIG. 23. Before lifting up this block G, some of the lifting units 33 are mounted on the ring girder 37 along a circle C1 on which lugs 39*a* extend in circumferentially spaced apart relation from the ring 39 as shown in FIG. 24. The threaded rods 336 of these lifting units 33 are anchored to these lugs 39*a* as shown in FIG. 23 so as to lift up the block G as shown in FIG. 25.

Figure 24:
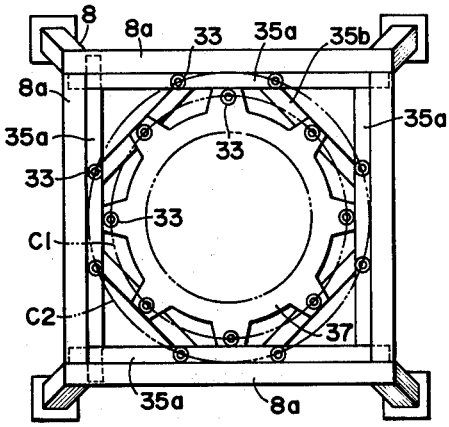
FIG. 24 is a plan view showing how the hydraulic lifting units are arranged to lift up a bustle pipe and an associated furnace body block.
Figure 25:
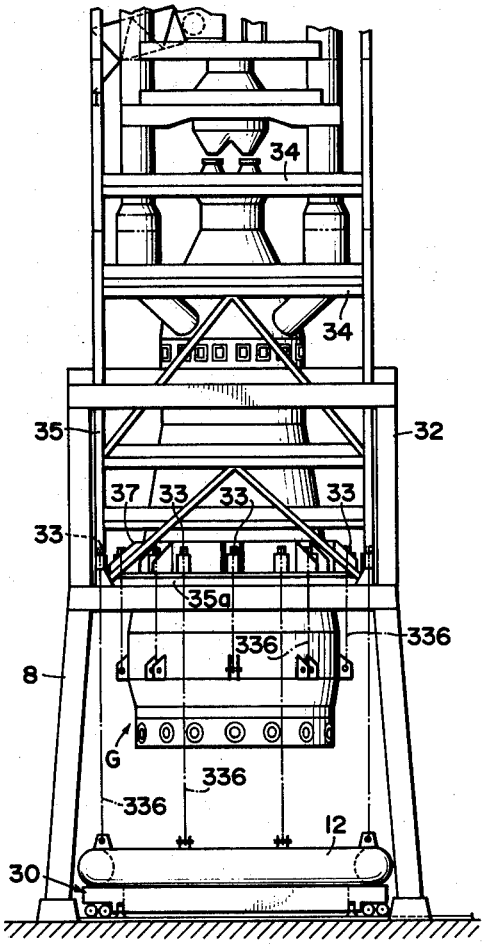
FIGS. 25 and 26 show the steps of lifting up the bustle pipe and associated furnace body block.

Simultaneously with the mounting of the lifting units 33 on the ring girder 37, another set of the lifting units 33 are mounted on the bottom beams 35*a* of the deck frame tower portion 35 as shown in FIG. 24 to prepare for the lift-up of a bustle pipe 12. These latter lifting units 33 are arranged along another circle C2 which is registered with the mean circle of the bustle pipe 12 as shown in FIG. 24.

Figure 26:
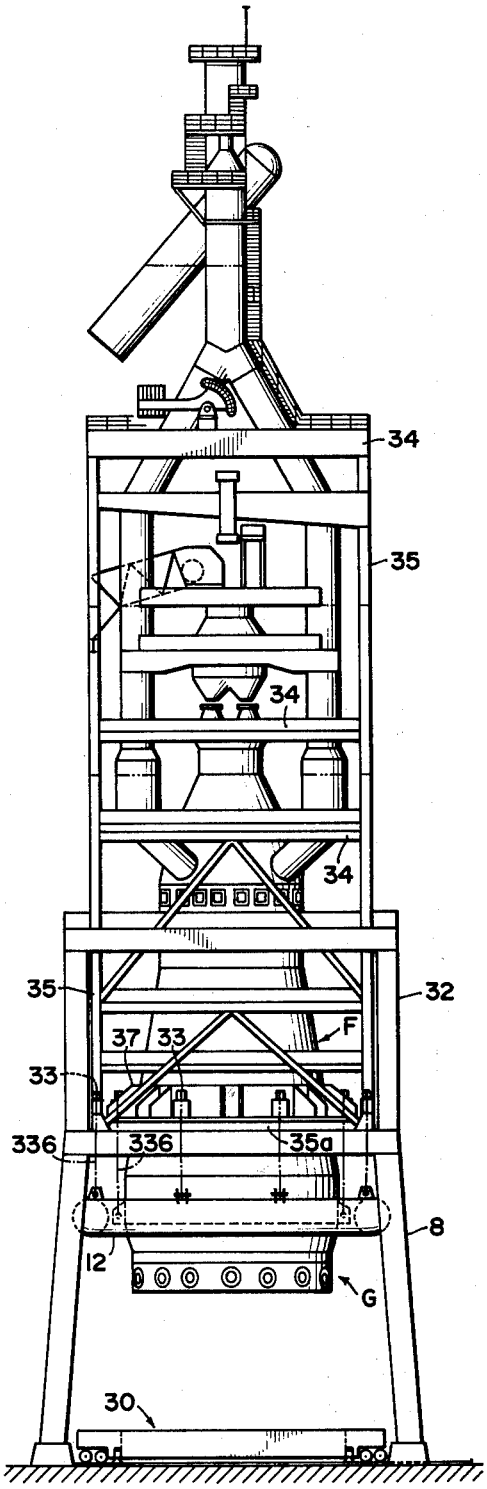

The bustle pipe 12 is lifted up by the lifting units 33 as shown in FIG. 26. Subsequently, the threaded rods 336 of the lifting units 33 used for the lift-up of the bustle pipe 12 are maintained in position by the bearing nuts 339 and rings 338 and are thus left on the bottom beams 35*a* of the deck frame tower portion 35 so as to hold the bustle pipe 12 in the lifted position.

Figure 27:
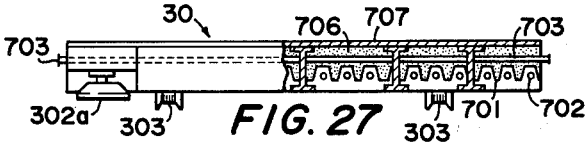
FIG. 27 is a partly cut-away side elevational view of the carriage when the frame structure of the carriage is reformed to provide the flat bottom base prior to the lift-up of a furnace bottom block.
Figure 28:
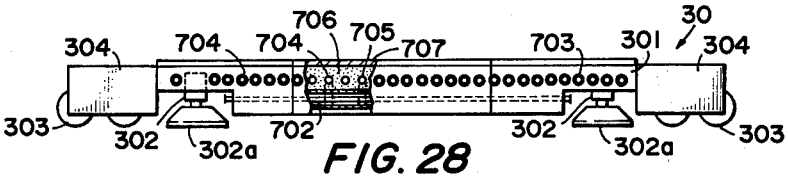
FIG. 28 is a partly cut-away side elevational view of FIG. 27 when viewed from another side.
Figure 29:
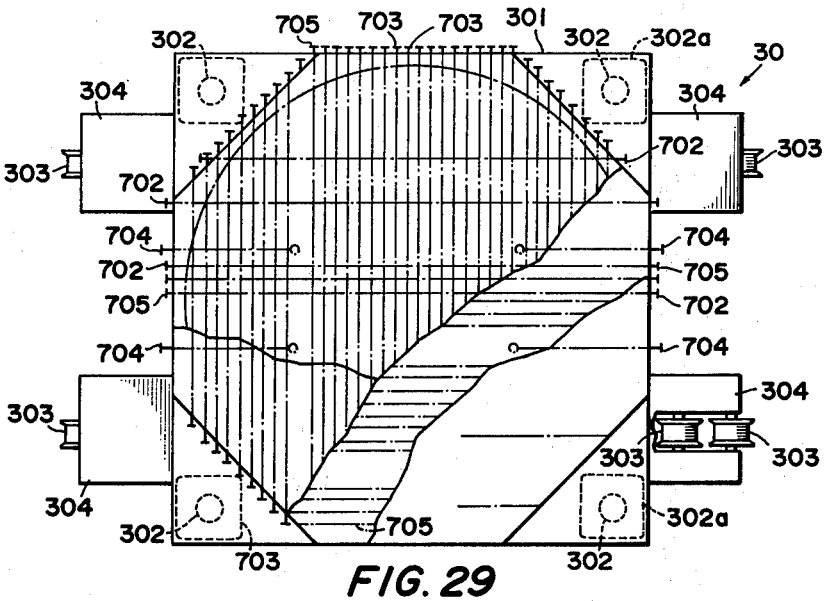
FIG. 29 is a top plan view of the carriage shown in FIG. 28.

After the blocks A to G and bustle pipe 12 have been successively lifted up in the manner described hereinbefore, the carriage 30 is returned to the assembly shop. In the assembly shop, the carriage 30 is reformed in its frame structure 301 as shown in FIGS. 27 to 29 so that the reformed frame structure 301 can provide the flat bottom base 7 of the furnace bottom structure. More precisely, as shown in FIG. 27, a steel plate 701 having many parallel channels is fixed to the bottom of the frame structure 301 of the carriage 30. Cooling air conduits 702 are disposed in these channels of the steel plate 701, and cooling water conduits 703 extending normal to the cooling air conduits 702 are disposed on the upper surface of the steel plate 701. These conduits 702 and 703 have their ends protruding from the ends of the steel plate 701 so as to facilitate later connection of the associated conduits of sources (not shown). As shown in FIGS. 28 and 29, grout charging conduits 704 and air venting conduits 705 opening at one end thereof to the exterior at the bottom of the frame structure 301 are disposed between these conduits 702 and 703. The grout charging conduits 704 protrude at the other end thereof from the side walls of the frame structure 301.

A filler 706 such as concrete or refractory filler material is filled into the spaces above the steel plate 701, and a thick steel plate 707 is laid on the layer of the filler 706 to complete major parts of the flat bottom base 7 in the furnace bottom structure.

Figure 30:
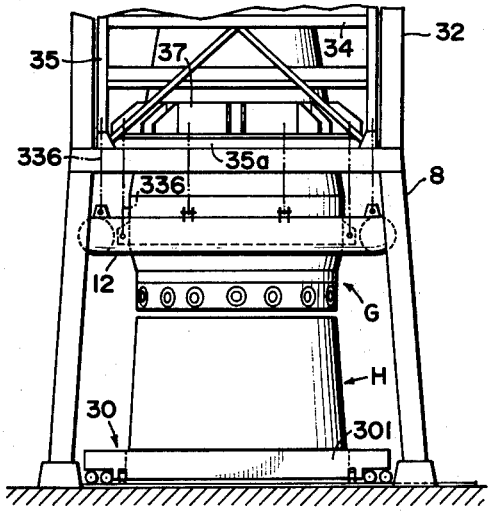
FIGS. 30 to 33 show the steps of mounting the furnace bottom block and the flat bottom base on the foundation to complete the blast furnace.
Figure 31:
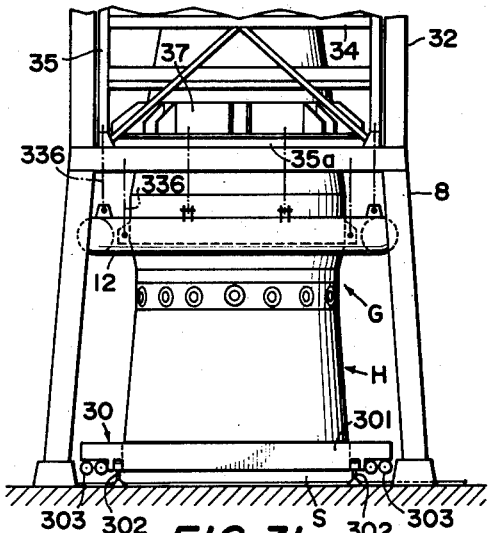

After the reformation of the frame structure 301 of the carriage 30 to provide the major parts of the flat bottom base 7 in the furnace bottom structure, a furnace bottom block H already assembled is carried by the carriage 30 onto the foundation 1 as shown in FIG. 30. The furnace bottom block H is then initially lifted up by the hydraulic jacks 302 of the carriage 30 together with the frame structure 301 as shown in FIG. 31. This block H is then joined to the lower end of the block G.

Figure 32:
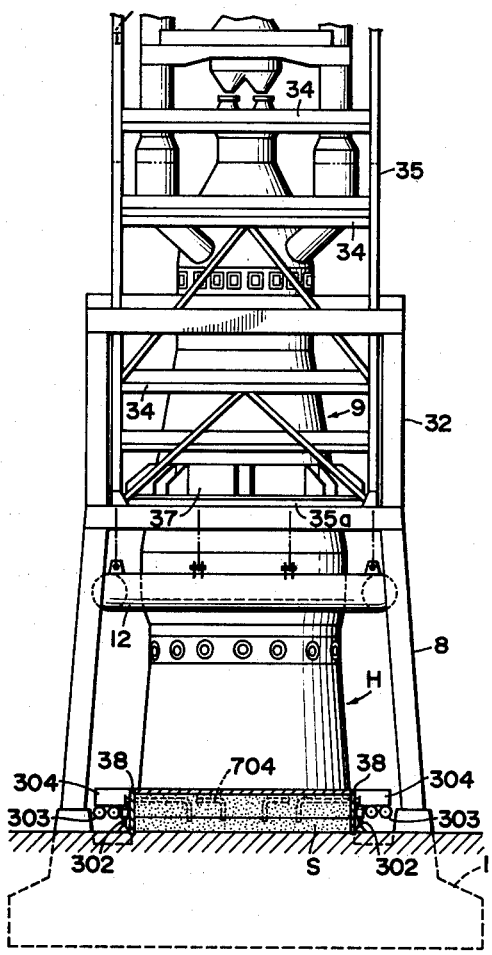

After the lift-up of the block H, a casting frame 38 is set to surround the frame structure 301 of the carriage 30 for casting grout into the space S defined between the frame structure 301 of the carriage 30 and the foundation 1. After the completion of the casting frame 38, quick-curing grout is casted into the space S from the grout charging conduits 704 fixed to the frame structure 301 of the carriage 30 as shown in FIG. 32.

Until the grout cures completely, the furnace bottom block H and the frame structure 301 of the carriage 30 are maintained in the position lifted up by the hydraulic jacks 302. During this period of time, the truck portions 304 carrying the wheels 303 of the carriage 30 are removed from the frame structure 301.

Figure 33:
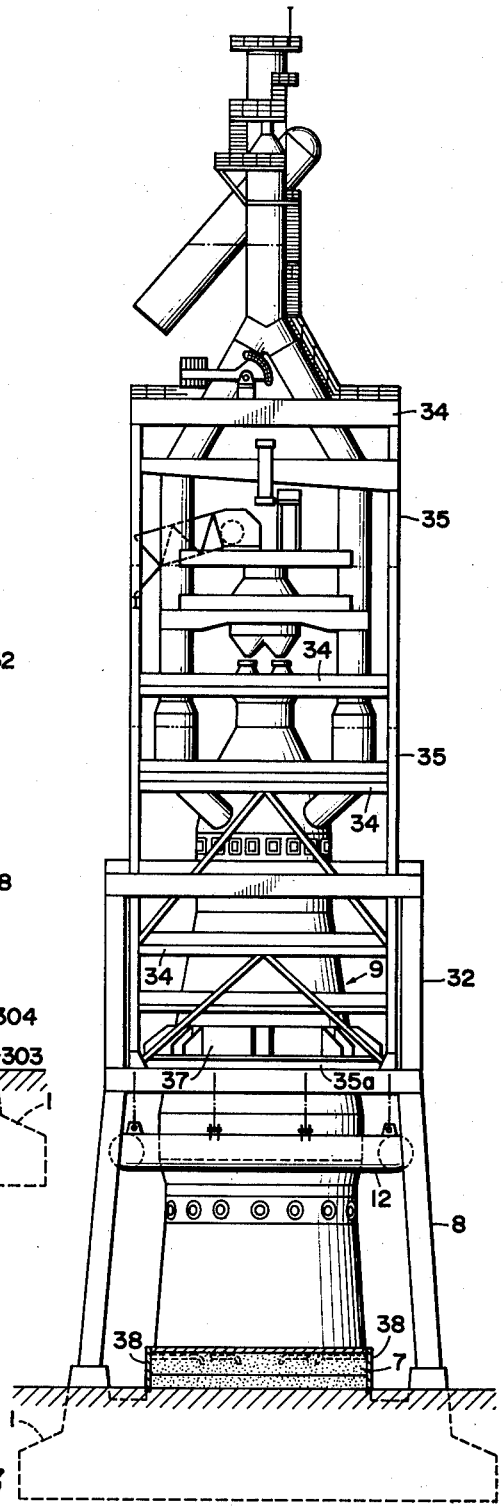

After the grout has cured completely, the hydraulic jacks 302 are removed to leave the flat bottom base 7 of the furnace bottom structure on the foundation 1 as shown in FIG. 33, thereby completing the erection of the blast furnace. After the erection of the blast furnace, the wedge-shaped liners *k* (FIG. 12) interposed between the deck frame 34 of the deck frame tower portion 35 and the projections **11*b* of the shell portion 11 are removed to separate the deck frame tower 35 from the furnace body 9**.

Even after the blast furnace has been completely constructed, the tower 32 is left in position to be utilized for later dismantling of the furnace or for periodic repairs. Further, the building of the assembly shop is left to be utilized as a part of the steel plant, and the track bed for the carriage is reused as a track bed for ladle cars or the like used for conveying melting iron from the blast furnace to converter plant.

It is to be understood that the accompanying drawings and the related description given herein are merely illustrative of one form of the present invention, and various changes and modifications may be made therein without departing from the scope of appended claims. For example, although the individual blocks are initially lifted up by the hydraulic jacks provided on the carriage in the illustrated embodiment, it is apparent to those skilled in the art that such hydraulic jacks may be installed on the foundation for the blast furnace for equally effectively achieving the object of the present invention.

What we claim is:

1. A method for constructing a blast furnace comprising the steps of:

a. constructing a foundation;

b. erecting a support column assembly for supporting a blast furnace on said foundation;

c. erecting an additional tower for blast furnace erecting and dismantling purposes on said support column assembly;

d. mounting a plurality of detachable hydraulic lifting means on said additional tower;

e. constructing a carriage having a frame structure effective to serve subsequent to erection of the furnace as a part of a furnace bottom structure;

f. providing said frame structure of said carriage with grout charging conduits for charging grout into the frame structure and with cooling pipes for cooling said furnace bottom structure;

g. assembling at a site remote from said foundation a plurality of furnace assembly blocks, said assembly blocks including a furnace top block, intermediate blocks and a furnace bottom block, and having brick lining, painting, electrical instrumentation, wiring, piping and any other necessary fittings;

h. transporting said blocks in a sequential order of assembly, proceeding from said furnace top block to said furnace bottom block, from said shop onto said foundation by said carriage;

i. lifting up said furnace top block by suitable ones of said hydraulic lifting means, and then transporting the first one of said intermediate blocks onto said foundation;

j. lifting the first one of said intermediate blocks and then joining said furnace top block with the first one of said intermediate blocks while maintaining the first one of said intermediate blocks placed on said frame structure of said carriage;

k. repeating said steps (h), (i), (j) with remaining blocks for the required number of times to lift up all the furnace blocks except the furnace bottom block by said hydraulic lifting means;

l. fixing lifting blocks on said support column assembly;

m. lifting up said furnace bottom block with said frame structure of said carriage simultaneously by suitable lifting means engaged with said frame structure of said carriage, and joining said furnace bottom block with upper blocks lifted up;

n. setting a casting frame around said frame structure of said carriage in its lifted-up condition for the purpose of defining a casting space over the foundation;

o. charging grout into said casting space and into said frame structure of said carriage through said grout charging conduits thereby constructing a furnace bottom structure having cooling pipes therethrough;

p. disengaging said lifting means engaged with said frame structure of said carriage, removing said casting frame and said hydraulic lifting means after curing of said grout charged into the casting space.

2. A method for constructing a blast furnace in accordance with claim 1, wherein said carriage constructing step (e) includes the step of affixing wheels to said frame structure and the step of affixing hydraulic jacks to said frame structure, said furnace bottom block and said frame structure of said carriage being lifted up by said hydraulic jacks affixed to said frame structure of said carriage in step (m), and said affixed hydraulic jacks and wheels being removed in step (p).

* * * * *